US006929346B2

(12) United States Patent
Balcan et al.

(10) Patent No.: US 6,929,346 B2
(45) **Date of Patent: *Aug. 16, 2005**

(54) SYSTEM AND METHOD FOR SERVICING NON-SCANNING PRINTHEAD

(75) Inventors: Petrica Dorinel Balcan, San Diego, CA (US); Mark McGarry, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 55 days.

This patent is subject to a terminal disclaimer.

(21) Appl. No.: 10/676,583

(22) Filed: Oct. 1, 2003

(65) Prior Publication Data

US 2004/0061735 A1 Apr. 1, 2004

Related U.S. Application Data

(63) Continuation of application No. 10/229,711, filed on Aug. 28, 2002, now Pat. No. 6,659,586.
(60) Provisional application No. 60/317,114, filed on Sep. 5, 2001.

(51) Int. Cl.[7] ..... B41J 2/165
(52) U.S. Cl. ..... 347/32; 347/29; 347/30; 347/33
(58) Field of Search ..... 347/28–35

(56) References Cited

U.S. PATENT DOCUMENTS 4,447,103 A 5/1984 Werth et al.
4,853,717 A 8/1989 Harmon et al.
5,610,640 A 3/1997 Anderson et al.
5,839,046 A 11/1998 Takano et al.
5,978,004 A 11/1999 Ehrhardt
6,132,026 A 10/2000 Taylor et al.
6,158,839 A 12/2000 Fukushima et al.
6,189,999 B1 2/2001 Pham et al.
6,193,353 B1 2/2001 Vives et al.
6,270,183 B1 8/2001 Gaarder
6,293,648 B1 * 9/2001 Anderson ..... 347/29
6,309,044 B1 10/2001 Gaarder
6,318,835 B2 11/2001 Nakahara
6,328,412 B1 12/2001 Taylor et al.
6,659,586 B2 * 12/2003 Balcan et al. ..... 347/32
2002/0044168 A1 4/2002 Hashi et al.

FOREIGN PATENT DOCUMENTS

EP 0598701 A2 12/1987
EP 0749837 A1 5/1996

* cited by examiner

*Primary Examiner*—Shih-wen Hsieh

(57) ABSTRACT

A system for servicing a non-scanning printhead includes a servicing plate, a servicing component mounted on the servicing plate and adapted to service the non-scanning printhead, and a drive system adapted to move the servicing plate between a storage position and a service position such that the servicing component is spaced from the non-scanning printhead when the servicing plate is in the storage position and the servicing component is adapted to service the non-scanning printhead when the servicing plate is in the service position.

35 Claims, 11 Drawing Sheets

SYSTEM AND METHOD FOR SERVICING NON-SCANNING PRINTHEAD

CROSS-REFERENCE TO RELATED APPLICATIONS

This application is a Continuation of U.S. patent application Ser. No. 10/229,711 filed on Aug. 28, 2002 now U.S. Pat. No. 6,659,586 which claims priority to U.S. Provisional Patent Application Ser. No. 60/317,114, filed on Sep. 5, 2001, each incorporated herein by reference.

BACKGROUND

An inkjet printing system may include a printhead and an ink supply which supplies liquid ink to the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Use of the inkjet printing system may result in the accumulation of ink and particles, such as dust or paper fibers, on the printhead. To ensure quality print jobs, it is desirable that the accumulated ink and particles be removed from the printhead to prevent the accumulated ink and particles from dropping onto the print medium or obstructing the ejection of ink from the nozzles. In addition, during non-use of the inkjet printing system, the nozzles are exposed to air which, consequently, may cause the ink to dry out and clog the nozzles.

In order to ensure quality print jobs it would be desirable to service and maintain the printhead to avoid the aforementioned problems.

SUMMARY OF THE INVENTION

A system for servicing a non-scanning printhead includes a servicing plate, a servicing component mounted on the servicing plate and adapted to service the non-scanning printhead, and a drive system adapted to move the servicing plate between a storage position and a service position such that the servicing component is spaced from the non-scanning printhead when the servicing plate is in the storage position and the servicing component is adapted to service the non-scanning printhead when the servicing plate is in the service position.

DESCRIPTION OF THE PREFERRED EMBODIMENTS

In the following detailed description of the preferred embodiments, reference is made to the accompanying drawings which form a part hereof, and in which is shown by way of illustration specific embodiments in which embodiments of the invention may be practiced. In this regard, directional terminology such as "up," "down," "forward," "backward," "leading," "trailing," "above," "below," etc., is used with reference to the orientation of the figure(s) being described. Because components of the embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
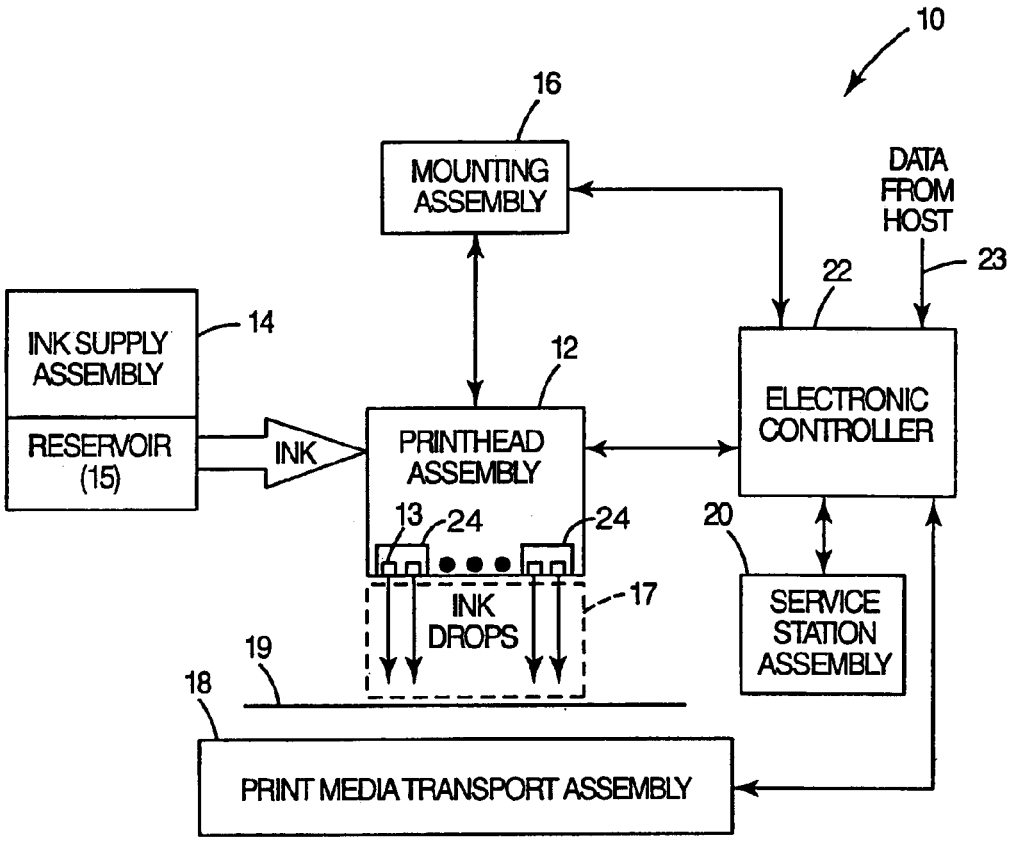
FIG. 1 is a block diagram illustrating one embodiment of an inkjet printing system including a system for servicing a non-scanning printhead.

FIG. 1 illustrates one embodiment of an inkjet printing system 10 including a system for servicing a non-scanning printhead. Inkjet printing system 10 includes an inkjet printhead assembly 12, an ink supply assembly 14, a mounting assembly 16, a print media transport assembly 18, a service station assembly 20, and an electronic controller 22. In one embodiment, inkjet printhead assembly 12 includes one or more printheads 24 which eject drops of ink through a plurality of orifices or nozzles 13 and toward an embodiment of media, such as print medium 19, so as to print onto print medium 19. Print medium 19 includes any type of suitable sheet material, such as paper, cardstock, transparencies, Mylar, cloth, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Figure 3:
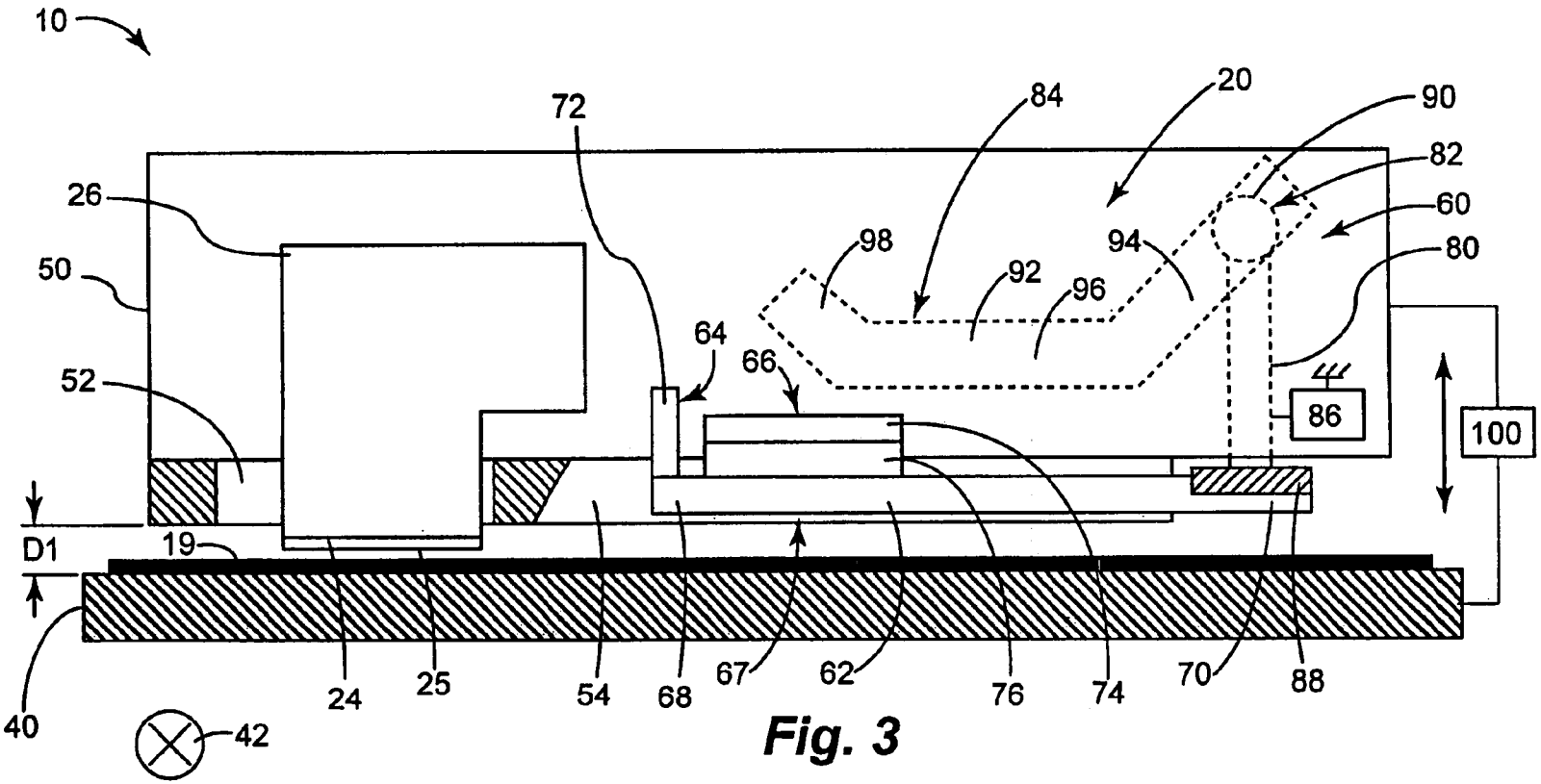
FIG. 3 is a schematic side view illustrating one embodiment of a non-scanning inkjet printing system in a printing position with a servicing system in a storage position.

Ink supply assembly 14 supplies ink to inkjet printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together to form an inkjet cartridge or pen 26 (FIG. 3). In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled.

Mounting assembly 16 supports inkjet printhead assembly 12 relative to print media transport assembly 18. Print media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a non-scanning or fixed printhead assembly. As such, mounting assembly 16 fixes inkjet printhead assembly 12 at a prescribed position relative to print media transport assembly 18. Thus, print media transport assembly 18 advances or positions print medium 19 relative to inkjet printhead assembly 12.

Service station assembly 20 includes at least one servicing component for wiping, capping, spitting, and/or priming of inkjet printhead assembly 12 in order to maintain functionality of inkjet printhead assembly 12 and, more specifically, nozzles 13, as will be further described below. Functions of service station assembly 20 rely on relative motion between service station assembly 20 and inkjet printhead assembly 12.

Electronic controller 22 communicates with inkjet printhead assembly 12, mounting assembly 16, print media transport assembly 18, and service station assembly 20. Electronic controller 22 receives data 23 from a host system, such as a computer, and includes memory for temporarily storing data 23. Typically, data 23 is sent to inkjet printing system 10 along an electronic, infrared, optical or other information transfer path. Data 23 represents, for example, a document and/or file to be printed. As such, data 23 forms a print job for inkjet printing system 10 and includes one or more print job commands and/or command parameters.

In one embodiment, electronic controller 22 provides control of inkjet printhead assembly 12 including timing control for ejection of ink drops from nozzles 13. As such, electronic controller 22 defines a pattern of ejected ink drops which form characters, symbols, and/or other graphics or images on print medium 19. Timing control and, therefore, the pattern of ejected ink drops is determined by the print job commands and/or command parameters.

Figure 2:
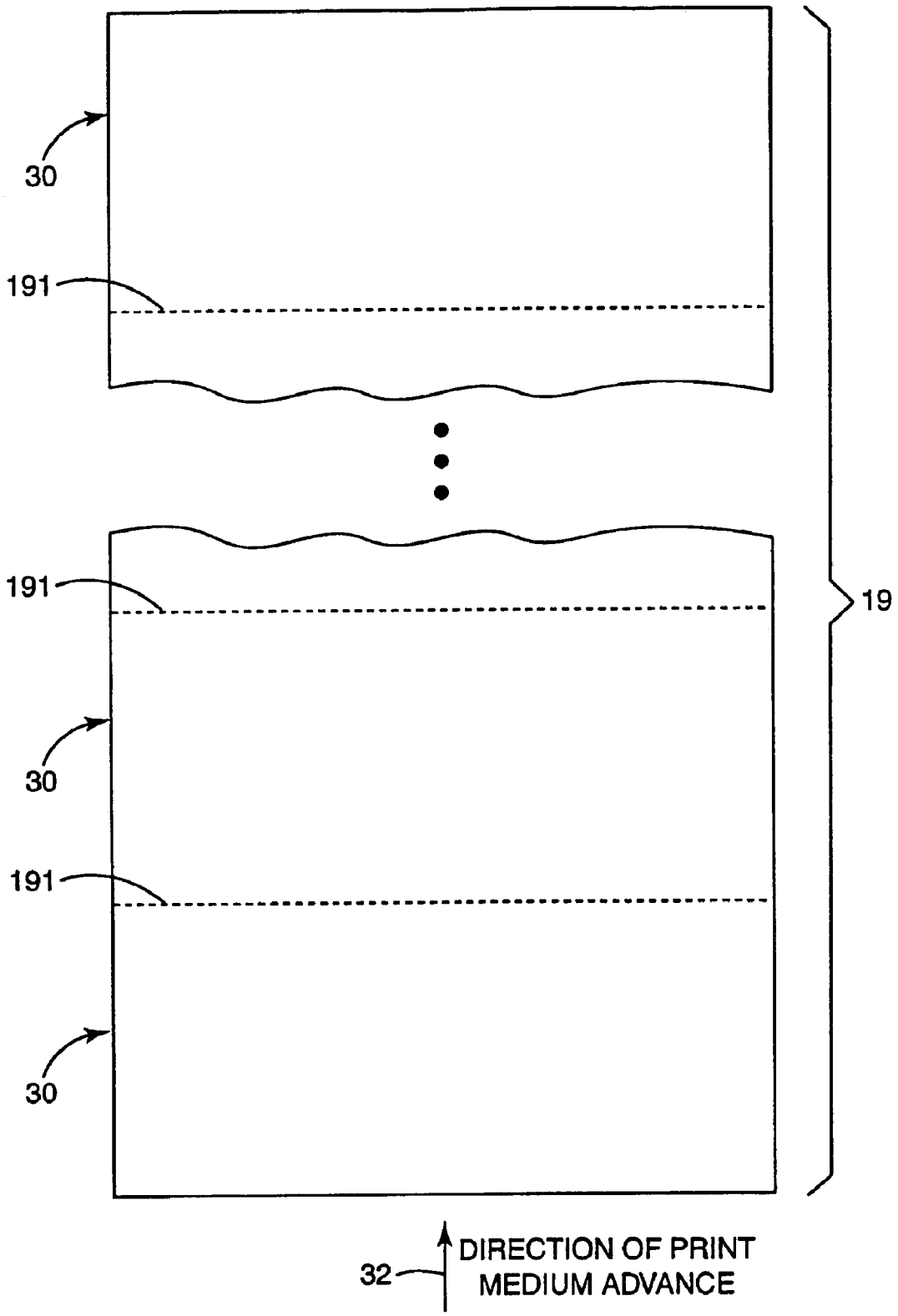
FIG. 2 is a schematic illustration of one embodiment of a portion of a continuous web print medium.

In one embodiment, as illustrated in FIG. 2, print medium 19 is a continuous form or continuous web print medium 19. As such, print medium 19 may include a plurality of continuous print medium sections 30. Print medium sections 30 represent, for example, individual sheets, forms, labels, or the like which may be physically separated from each other by cutting or tearing along, for example, perforated lines 191. In addition, print medium 19 may include a continuous roll of unprinted paper with print medium sections 30 individually delineated by indicia, openings, or other markings. Since inkjet printhead assembly 12 is fixed, print medium 19 moves relative to inkjet printhead assembly 12 during printing. More specifically, print medium 19 is advanced relative to inkjet printhead assembly 12 in a direction indicated by arrow 32.

FIG. 3 illustrates one embodiment of a portion inkjet printing system 10. Inkjet printing system 10 includes a printhead 24, a service station assembly 20, a platen 40, and a printhead mounting plate 50. Platen 40, as part of print media transport assembly 18, supports print medium 19 so that print medium 19 may be advanced relative to platen 40 in a direction perpendicular to a plane defined by FIG. 3, as indicated by direction arrow 42. Printhead mounting plate 50, as part of mounting assembly 16, is positioned to support printhead 24 relative to platen 40 and print medium 19.

Figure 11:
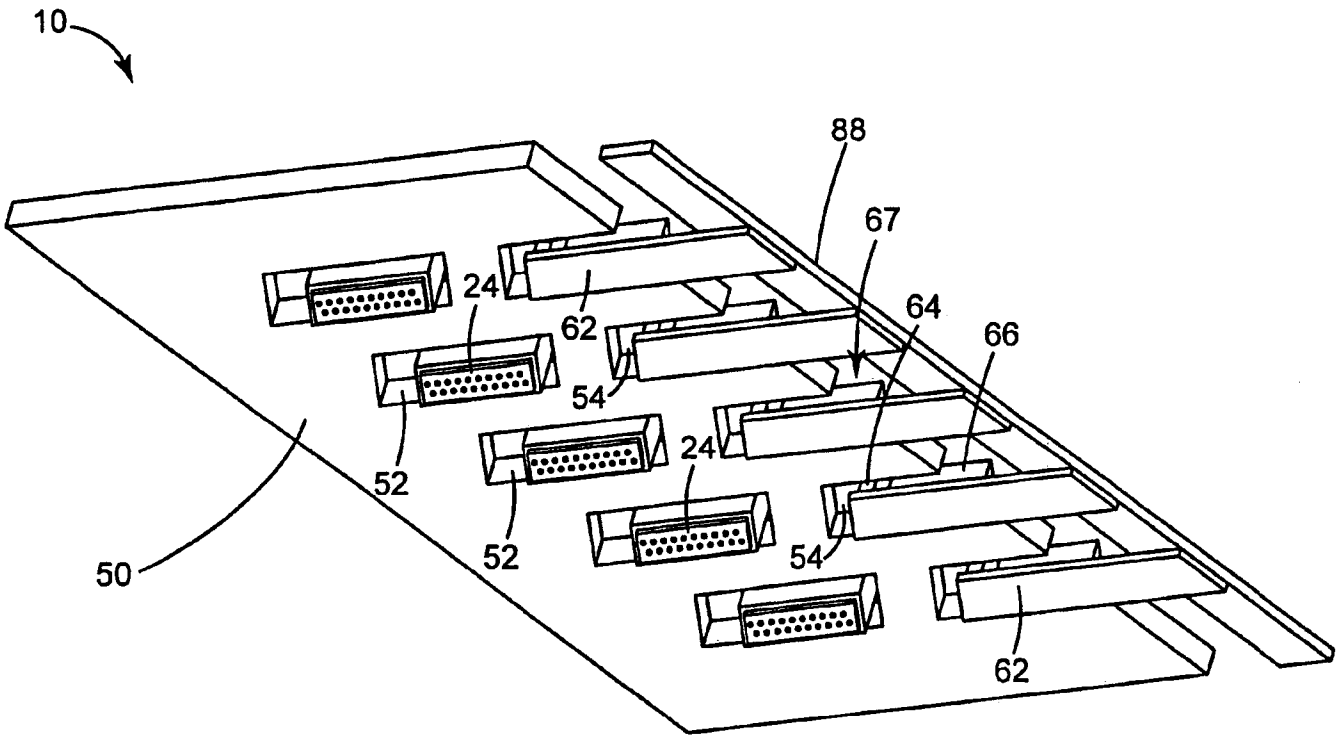
FIG. 11 is a schematic bottom view illustrating another embodiment of a non-scanning inkjet printing system including a plurality of printheads and a plurality of service stations.

In one embodiment, printhead mounting plate 50 includes a printhead aperture 52 and a clearance aperture 54 (FIGS. 3 and 11). Printhead aperture 52 receives printhead 24 such that printhead 24 extends through printhead aperture 52 towards print medium 19. Clearance aperture 54 is sized and shaped to receive service station assembly 20 such that service station assembly 20 may be selectively moved into and out of printhead mounting plate 50. Accordingly, service station assembly 20 is movably connected to printhead mounting plate 50, as will be further described below.

In one embodiment, as illustrated in FIG. 3, service station assembly 20 includes a drive system 60, a servicing plate 62, and first and second servicing components 64 and 66, respectively. Drive system 60 effectuates movement of servicing plate 62 relative to printhead mounting plate 50 and, therefore, printhead 24, as described below, to service printhead 24. Servicing plate 62 supports servicing components 64 and 66 and includes a leading end 68 and a trailing end 70. Leading end 68 is located nearer printhead 24 than is trailing end 70. Servicing components 64 and 66 are each mounted on and move with servicing plate 62. Servicing components 64 and 66 and servicing plate 62 collectively form a service station 67. In one embodiment, servicing components 64 and 66 are mounted adjacent to and/or toward leading end 68 of servicing plate 62.

Servicing components 64 and 66 are positioned on servicing plate 62 such that each servicing component 64 and 66 interacts with or services printhead 24 when servicing plate 62 is in a corresponding service position. For example, servicing component 64 services printhead 24 when servicing plate 62 is in a first service position, and servicing component 66 services printhead 24 when servicing plate 62 is in a second service position. Notably, servicing plate 62 may support one servicing component or a number of servicing components, such as a wiper, a cap and a spring, and/or a spittoon, in a variety of different configurations and, therefore, may service printhead 24 from a variety of different service positions or combinations thereof.

In one embodiment, servicing component 64 may include a rubber blade or wiper 72. Wiper 72 is supported by servicing plate 62 and extends upwardly (with respect to the orientation of FIG. 3) from servicing plate 62. As such, wiper 72 may be selectively passed across printhead 24 to scrape printhead 24 and remove any residual ink, collected fibrous material, or other debris that may collect on printhead 24.

In one embodiment, servicing component 66 may include a cap 74. Cap 74 is sized to cover a front face 25 of printhead 24 to seal and protect nozzles 13 (FIG. 1) from drying out during periods of non-use. In one embodiment, servicing component 66 may include one or more springs 76 which bias cap 74 against printhead 24.

As described above, drive system 60 moves servicing plate 62 relative to printhead mounting plate 50 and, therefore, printhead 24. In one embodiment, drive system 60 is connected to servicing plate 62 near trailing end 70 opposite of servicing components 64 and 66 such that drive system 60 does not interfere with the interaction between servicing components 64 and 66 and printhead 24.

In one embodiment, as illustrated in FIG. 3, drive system 60 includes a drive block 80, a drive element 82, a drive feature 84, and a drive actuator 86. Drive block 80 is connected to and extends between servicing plate 62 and drive element 82. Drive block 80 may be connected to servicing plate 62 directly or by a drive arm 88, which extends along or near trailing end 70 of servicing plate 62.

In one embodiment, drive feature 84 is associated with printhead mounting plate 50 and drive element 82 is connected to servicing plate 62. Drive element 82 interacts with drive feature 84 to move servicing plate 62 relative to printhead mounting plate 50. More particularly, drive element 82 and drive feature 84 interact to guide servicing plate 62 and, therefore, service station 67 between a storage position, as illustrated in FIG. 3, and one or more service positions.

In the storage position, servicing plate 62 is positioned in clearance aperture 54 and recessed at least partially within printhead mounting plate 50. Thus, service station assembly 20 does not interfere with the spacing between printhead 24 and print medium 19 during the printing process. In the service positions, servicing plate 62 is displaced from clearance aperture 54 and positioned between printhead mounting plate 50 and platen 40 to facilitate servicing of printhead 24 with servicing components 64 and 66.

In one embodiment, drive actuator 86 is coupled with printhead mounting plate 50 and drive block 80 to move drive block 80 and, therefore, servicing plate 62 as drive element 82 interacts with drive feature 84. More specifically, drive actuator 86 is secured to printhead mounting plate 50 such that actuation of drive actuator 86 generates movement of drive block 80 relative to printhead mounting plate 50. Alternatively, drive actuator 86 may be directly coupled with drive element 82, drive arm 88, or servicing plate 62, rather than drive block 80, to move servicing plate 62 relative to printhead 24. Drive actuator 86 may include a ballscrew, a leadscrew, an air cylinder, a hydraulic cylinder, or other actuation device.

In one embodiment, drive element 82 includes a cam follower 90 and drive feature 84 includes a cam slot 92. Cam follower 90 fits within and follows cam slot 92 to guide and move servicing plate 62 relative to printhead mounting plate 50. In one embodiment, cam slot 92 is formed in a sidewall of printhead mounting plate 50 and cam follower 90 includes a pin which fits into cam slot 92.

In one embodiment, cam slot 92 includes cam slot regions 94, 96, and 98. Cam slot regions 94, 96, and 98 define a single slot which forms cam surfaces which guide cam follower 90 and move servicing plate 62 between the storage position and the service positions. In one embodiment, cam slot region 94 is oriented at a non-parallel angle with respect to cam slot region 96 for moving servicing plate 62 from the storage position to a first service position. In addition, cam slot region 96 communicates with cam slot region 94 and extends between cam slot region 94 and cam slot region 98. Cam slot region 96 is oriented such that servicing plate 62 can move back and forth relative to printhead 24 to service printhead 24. Furthermore, cam slot region 98 communications with cam slot region 96 opposite of cam slot region 94 and is oriented at a non-parallel angle with respect to cam slot region 96 for moving servicing plate 62 to a second service position.

In one embodiment, cam slot region 94 is longer and extends further upwardly from cam slot region 96 than cam slot region 98. Thus, servicing plate 62 may be recessed within clearance aperture 54 of printhead mounting plate 50 when in the storage position. Notably, cam slot 92 may be formed in a number of configurations for supporting and guiding cam follower 90 and, consequently, servicing plate 62 in and between the storage position and one or more service positions.

In one embodiment, as illustrated in FIG. 3, inkjet printing system 10 includes a lift actuator 100. Lift actuator 100 is coupled with printhead mounting plate 50 to selectively move printhead mounting plate 50 towards and away from platen 40 and, therefore, position printhead 24 relative to print medium 19. While lift actuator 100 is illustrated as being coupled with printhead mounting plate 50 and platen 40, it is understood that lift actuator 100 may be coupled with printhead mounting plate 50 and other components of inkjet printing system 10 so as to provide relative positioning between printhead mounting plate 50 and platen 40.

Figure 4:
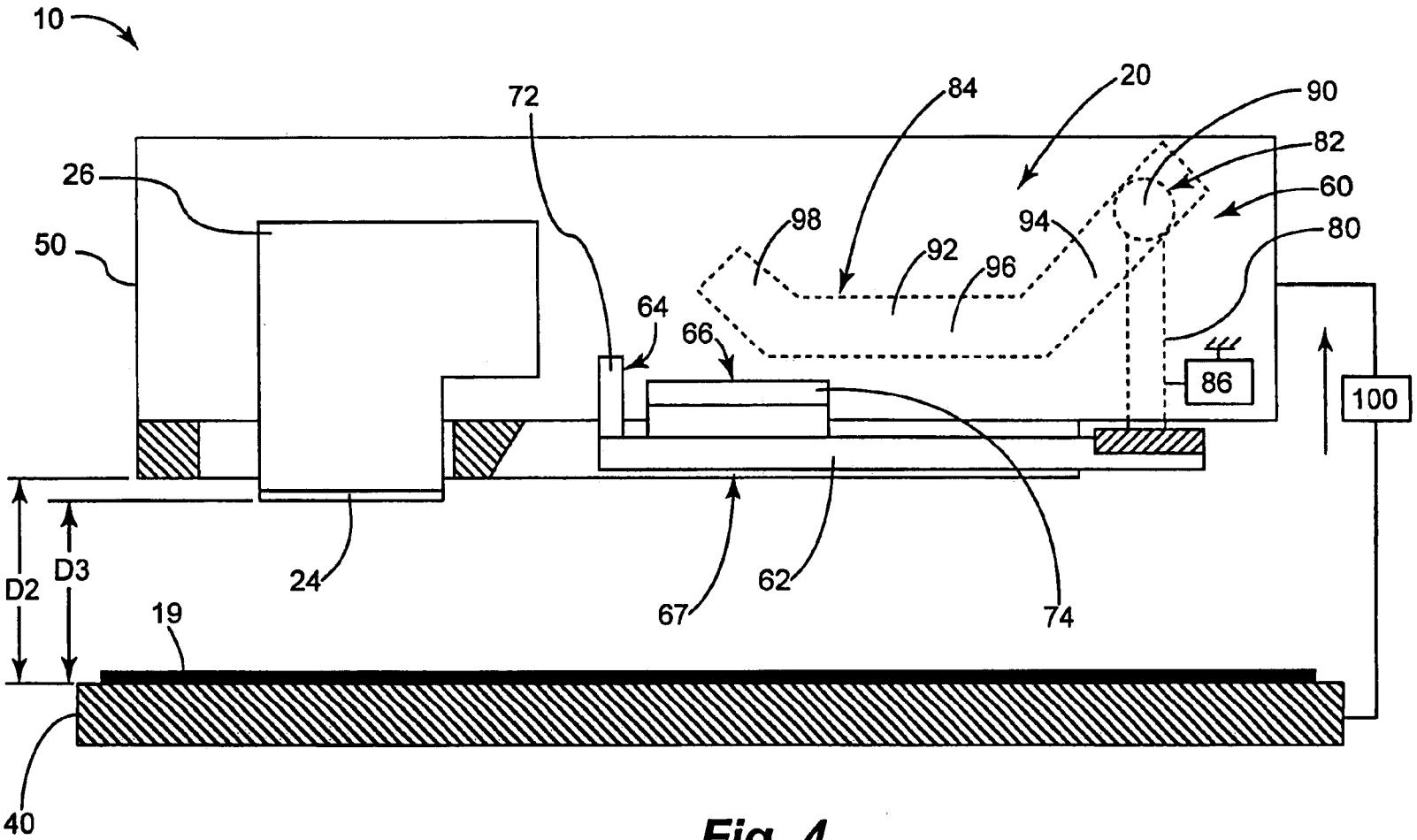
FIG. 4 is a schematic side view illustrating one embodiment of the non-scanning inkjet printing system of FIG. 3 in a servicing position.

In one embodiment, as illustrated in FIGS. 3 and 4, lift actuator 100 moves printhead mounting plate 50 between a printing position, as illustrated in FIG. 3, and a servicing position, as illustrated in FIG. 4. In the printing position, printhead mounting plate 50 is spaced a distance D1 from platen 40. In the servicing position, printhead mounting plate 50 is spaced a distance D2 from platen 40. Notably, when printhead mounting plate 50 is in the printing position, printhead 24 is positioned to print onto print medium 19. Conversely, when printhead mounting plate 50 is in the servicing position, printhead 24 is positioned to be serviced by service station assembly 20. Thus, distance D2 is greater than distance D1 to facilitate positioning of servicing plate 62 between printhead mounting plate 50 and platen 40 for servicing of printhead 24 with servicing components 64 and 66, as described below.

FIGS. 3–6 illustrate one embodiment of servicing printhead 24 with service station assembly 20. FIG. 3 illustrates one embodiment of printhead mounting plate 50 when in the printing position and servicing plate 62 when in the storage position. Printhead mounting plate 50 remains in the printing position during a printing process. In one embodiment, when servicing plate 62 is in the storage position, servicing plate 62 is positioned in clearance aperture 54 of printhead mounting plate 50. As such, servicing plate 62 is recessed at least partially within printhead mounting plate 50 and is positioned so that servicing plate 62 is held above (with respect to the orientation of FIG. 3) front face 25 of printhead 24. As such, service station assembly 20 does not interfere with the spacing between printhead 24 and print medium 19 during the printing process.

In one embodiment, as illustrated in FIG. 4, to service printhead 24, lift actuator 100 effectuates movement of printhead mounting plate 50 to the servicing position. As such, printhead 24 is spaced a distance D3 from platen 40 so that space is created between printhead 24 and platen 40 to facilitate servicing of printhead 24.

Once printhead 24 is spaced from platen 40, as illustrated in FIG. 4, drive actuator 86 is actuated to move drive system 60 so that servicing plate 62 moves relative to printhead mounting plate 50. In particular, the initial motion imparted by drive actuator 86 translates cam follower 90 along cam slot 92, namely along cam slot region 94 to cam slot region 96. Since cam follower 90 is connected to servicing plate 62 via, for example, drive block 80, movement of cam follower 90 along cam slot region 94 to cam slot region 96 induces movement of servicing plate 62 from the storage position, as illustrated in FIG. 4, to a first service position, as illustrated in FIG. 5.

Figure 5:
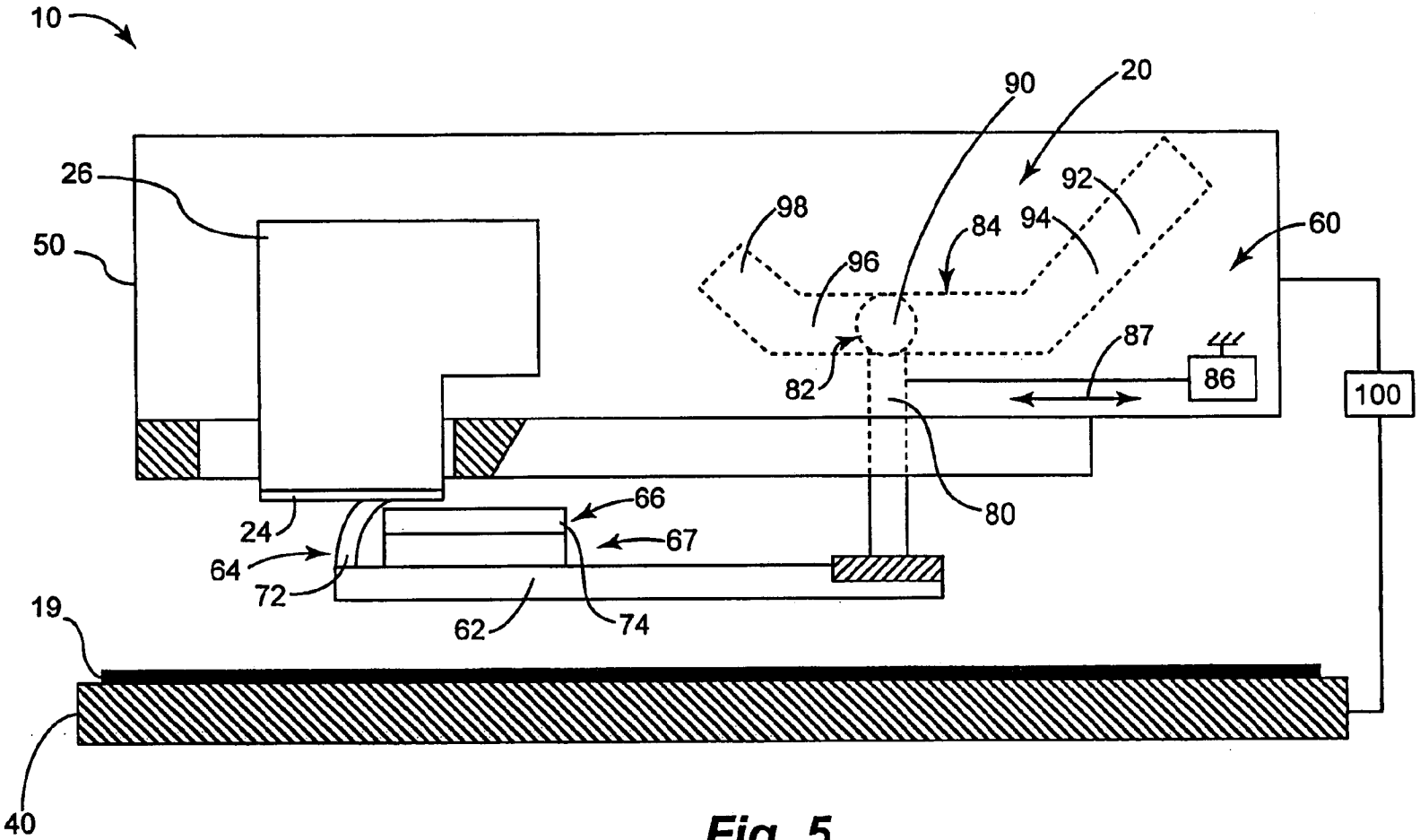
FIG. 5 is a schematic side view illustrating one embodiment of the non-scanning inkjet printing system of FIG. 3 with the servicing system in a service position.

In one embodiment, as illustrated in FIG. 5, the first service position of servicing plate 62 enables wiper 72 to contact printhead 24. The first service position may include a plurality of positions in which cam follower 90 is supported by cam slot region 96 such that drive actuator 86 moves cam follower 90 along cam slot region 96 to selectively move wiper 72 in and out of contact with printhead 24. In one embodiment, drive actuator 86 may be selectively actuated in the directions indicated by double arrow 87 to move cam follower 90 along cam slot region 96 and selectively move wiper 72 back and forth across printhead 24. Notably, the substantially horizontal orientation of cam slot region 96 facilitates back and forth movement of servicing plate 62 while maintaining contact between wiper 72 and printhead 24.

Figure 6:
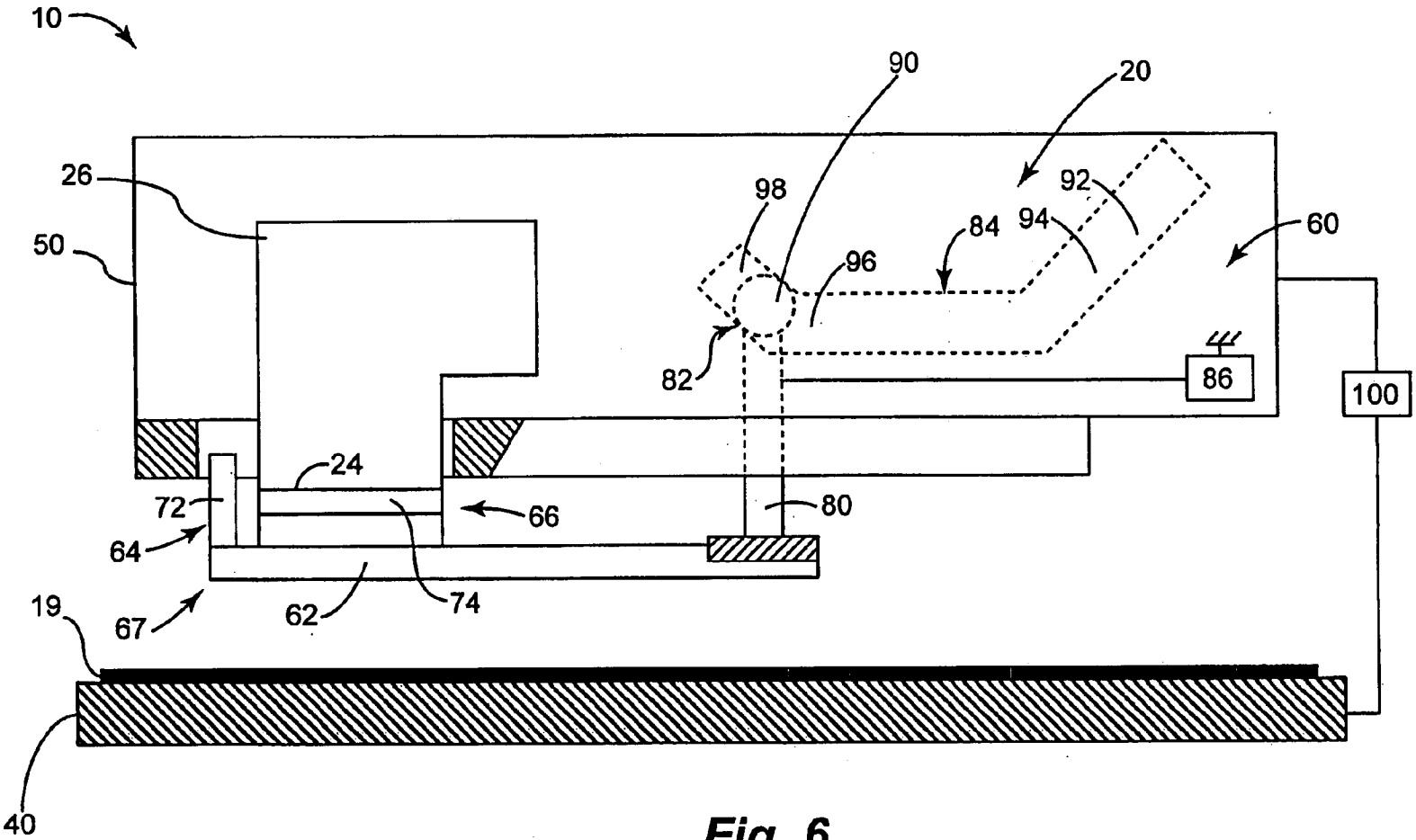
FIG. 6 is a schematic side view illustrating one embodiment of the non-scanning inkjet printing system of FIG. 3 with the servicing system in another service position.

As illustrated in FIG. 6, subsequent actuation of drive actuator 86 moves servicing plate 62 to a second service position. More particularly, servicing plate 62 is moved to the second service position as cam follower 90 is driven along cam slot region 96 to cam slot region 98 so that servicing plate 62 moves up and under printhead 24 permitting cap 74 to mate with and cap printhead 24. In one embodiment, printhead aperture 52 is sized to receive wiper 72 so that cap 74 can effectively seal printhead 24 as servicing plate 62 moves up and under printhead 24.

Drive actuator 86 may also be actuated to impart return movement of servicing plate 62 from the second service position back to the first service position and from the first service position back to the storage position. Otherwise stated, drive actuator 86 may be actuated to move cam follower 90 down cam slot region 98, across cam slot region 96, and up cam slot region 94, thereby, returning servicing plate 62 to the storage position. Furthermore, servicing plate 62 may move from the first service position back to the storage position without moving to the second service position.

Figure 7:
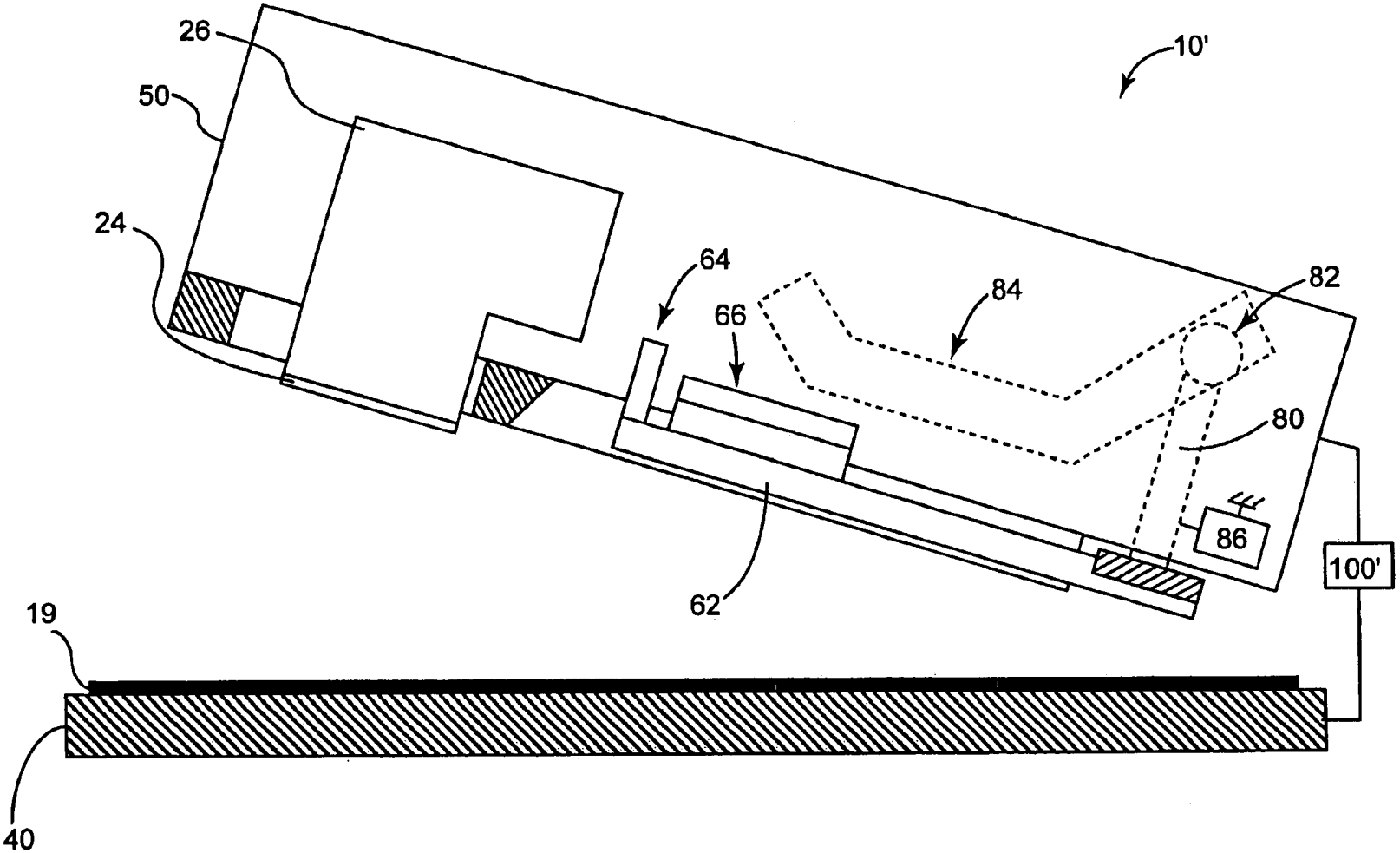
FIG. 7 is a schematic side view illustrating another embodiment of a non-scanning inkjet printing system in a servicing position.

FIG. 7 illustrates another embodiment of an inkjet printing system. Inkjet printing system 10' includes printhead 24, service station assembly 20, platen 40, and printhead mounting plate 50, as described above. Inkjet printing system 10', however, includes a lift actuator 100'. Lift actuator 100' is coupled with printhead mounting plate 50 to move printhead mounting plate 50 relative to platen 40. Lift actuator 100' distances or spaces printhead 24 from platen 40 and print medium 19 by tilting printhead mounting plate 50 away from platen 40 to position printhead mounting plate 50 in a printhead servicing position. As such, servicing station assembly 20 may service printhead 24 in the manner described above. It is understood that lift actuator 100' may also lift and tilt printhead mounting plate 50 away from platen 40 to position printhead mounting plate 50 in the printhead servicing position.

As illustrated in the embodiment of FIGS. 3–7, drive feature 84 is associated with printhead mounting plate 50 and drive element 82 is connected to servicing plate 62. More specifically, cam slot 92 is formed in printhead mounting plate 50 and cam follower 90 is secured to drive block 80 which, in turn, is connected to servicing plate 62. As such, drive block 80, cam follower 90, and servicing plate 62 move as a unit. Thus, actuation of drive block 80 causes drive block 80 and, therefore, cam follower 90 to move within cam slot 92 relative to printhead mounting plate 50 to guide servicing plate 62 and, therefore, service station 67 between the storage position, as illustrated in FIGS. 3 and 4, and one or more service positions, as illustrated, for example, in FIGS. 5 and 6.

Figure 8:
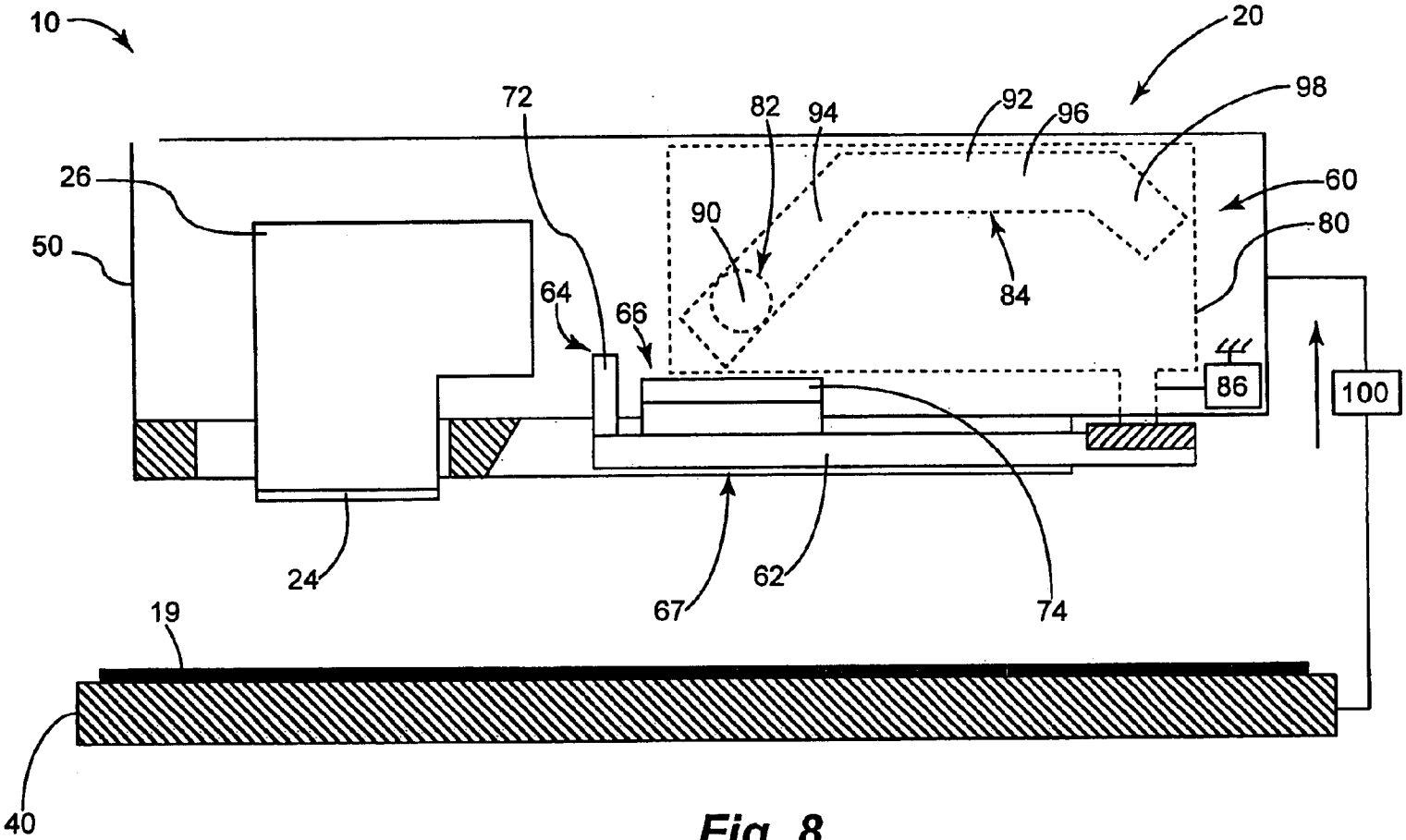
FIG. 8 is a schematic side view illustrating another embodiment of a non-scanning inkjet printing system in a servicing position with a servicing system in a storage position.
Figure 9:
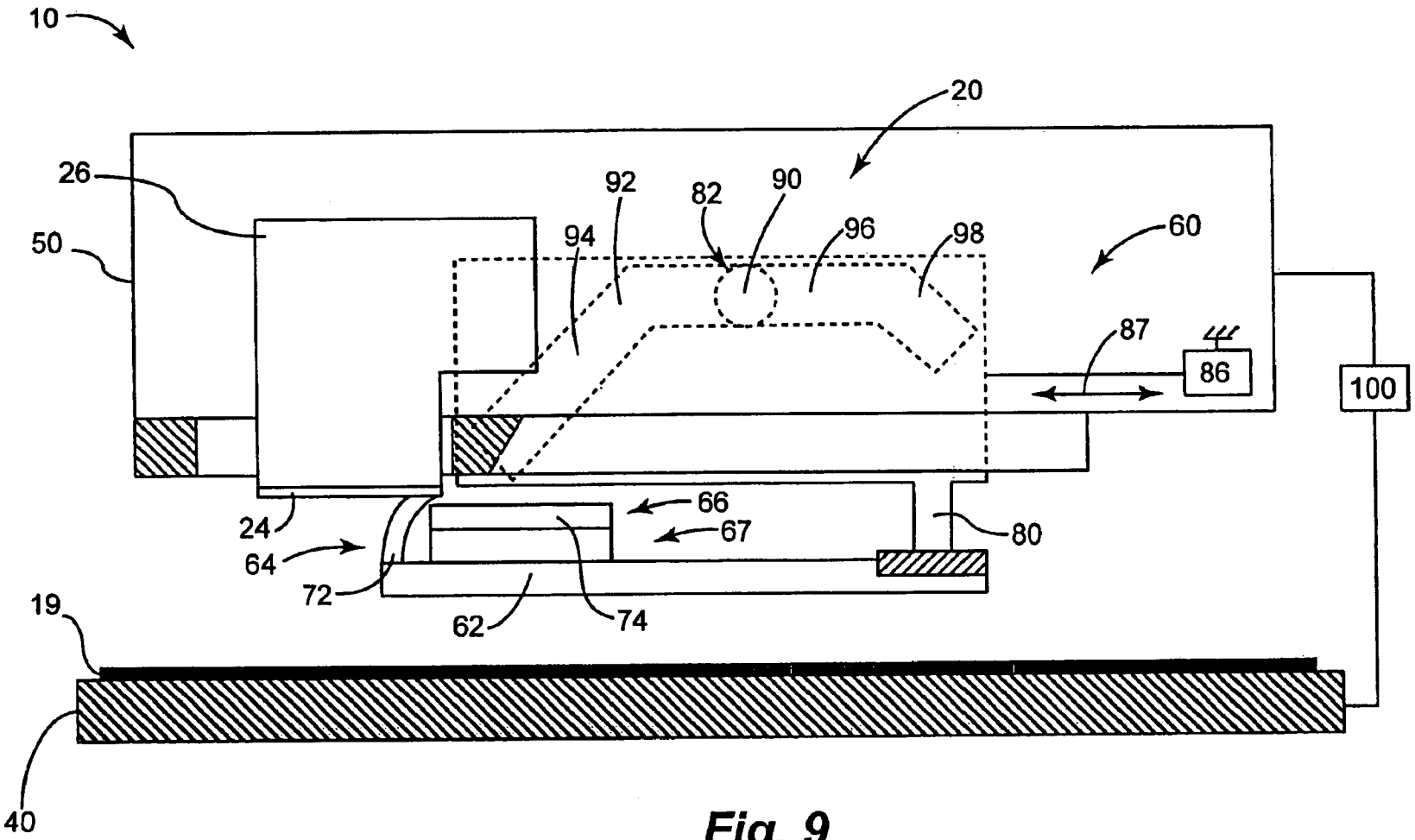
FIG. 9 is a schematic side view illustrating one embodiment of the non-scanning inkjet printing system of FIG. 8 with the servicing system in a service position.
Figure 10:
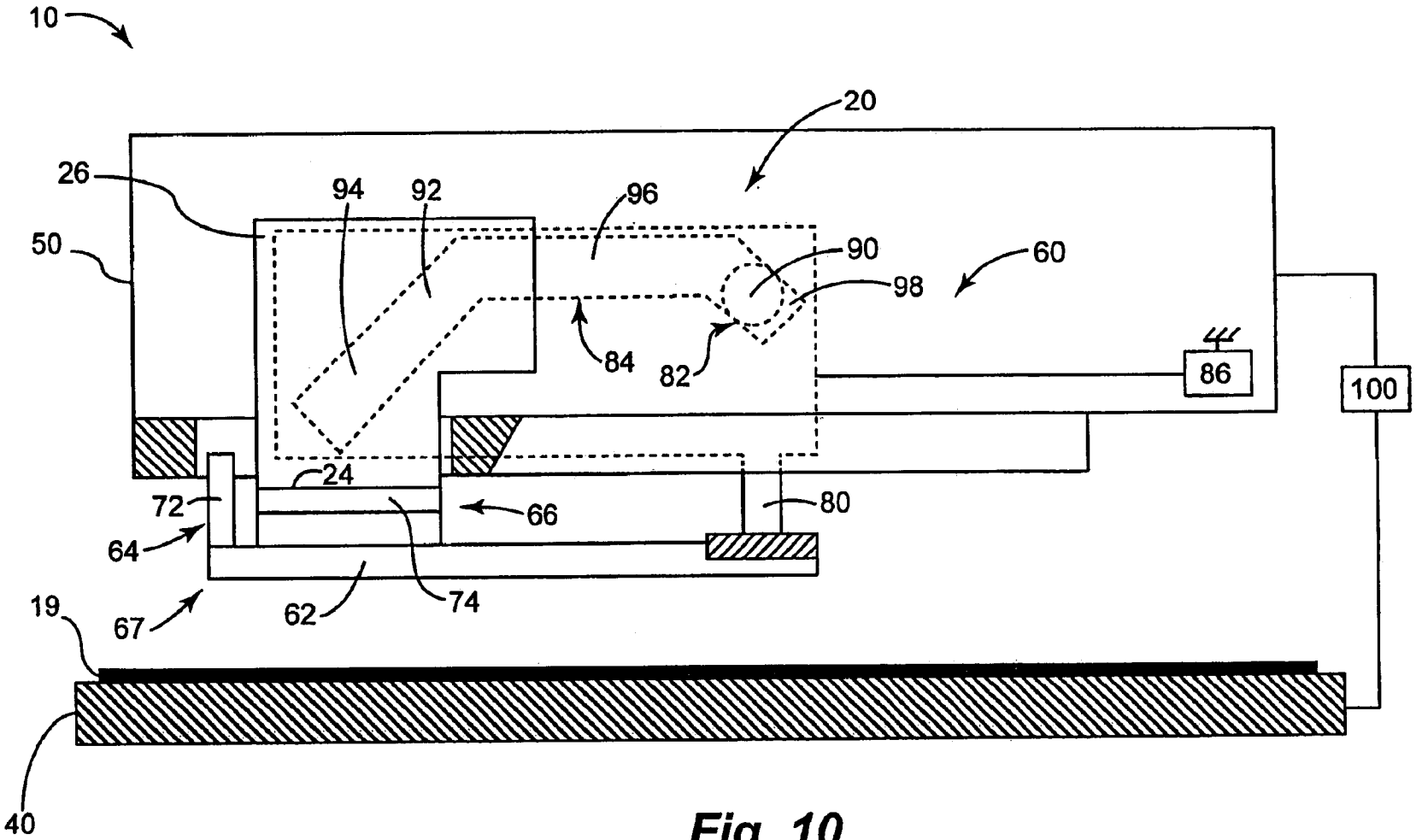
FIG. 10 is a schematic side view illustrating one embodiment of the non-scanning inkjet printing system of FIG. 8 with the servicing system in another service position.

As illustrated in the embodiment of FIGS. 8–10, however, drive element 82 is connected to printhead mounting plate 50 and drive feature 84 is associated with servicing plate 62. More specifically, cam follower 90 is secured to printhead mounting plate 50 and cam slot 92 is formed in drive block 80 which, in turn, is connected to servicing plate 62. As such, drive block 80, cam slot 92, and servicing plate 62 move as a unit. Thus, actuation of drive block 80 causes drive block 80 and, therefore, cam slot 92 to move along cam follower 90 relative to printhead mounting plate 50 to guide servicing plate 62 and, therefore, service station 67 between the storage position, as illustrated in FIG. 8, and one or more service positions, as illustrated, for example, in FIGS. 9 and 10.

In one embodiment, as illustrated in FIG. 11, inkjet printing system 10, as does inkjet printing system 10', includes a plurality of printheads 24 and a plurality of service stations 67 each including a respective servicing plate 62 and one or more servicing components 64 and/or 66. In this embodiment, printhead mounting plate 50 includes a plurality of printhead apertures 52 and a plurality of clearance apertures 54. Each printhead 24 is received by a corresponding printhead aperture 52 such that each printhead 24 protrudes from a respective printhead aperture 52 toward platen 40 and print medium 19 (FIGS. 3–10). Clearance apertures 54 are sized and shaped to allow service stations 67 to be selectively moved into and out of printhead mounting plate 50 between the storage position and one or more service positions, as described above.

In one embodiment, as illustrated in FIG. 11, printheads 24 and, therefore, printhead apertures 52 are spaced apart and staggered such that each printhead 24 is aligned with and/or overlaps at least one adjacent printhead 24. In one embodiment, printheads 24 are arranged in a stair-step manner. In another embodiment, printheads 24 are arranged in a plurality of stair-step patterns.

Service stations 67 are arranged to correspond with the arrangement of printheads 24 such that each service station 67 can service a corresponding printhead 24. For example, as illustrated in FIG. 11, a stair-step arrangement of printheads 24 results in a corresponding stair-step arrangement of service stations 67. In one embodiment, service stations 67 are each joined to drive arm 88 such that movement of drive arm 88 causes simultaneous movement of service stations 67.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A system for servicing a non-scanning printhead, the system comprising:

a servicing plate;

a servicing component mounted on the servicing plate and adapted to service the non-scanning printhead;

a first actuator adapted to move the non-scanning printhead and the servicing plate in a first direction; and a second actuator adapted to move the servicing plate between a storage position and a service position in a second direction substantially perpendicular to the first direction, wherein the servicing component is spaced from the non-scanning printhead when the servicing plate is in the storage position and the servicing component is adapted to service the non-scanning printhead when the servicing plate is in the service position.

2. The system of claim 1, wherein the first direction is substantially perpendicular to a face of the non-scanning printhead.

3. The system of claim 1, wherein the second direction is substantially parallel to a face of the non-scanning printhead.

4. The system of claim 1, further comprising:

a drive feature; and a drive element adapted to interact with the drive feature to move the servicing plate between the storage position and the service position relative to the non-scanning printhead.

5. The system of claim 1, wherein the service position includes a first service position and a second service position, wherein the second actuator is adapted to move the servicing plate between the first service position and the second service position.

6. The system of claim 1, wherein the servicing component includes a wiper adapted to wipe the non-scanning printhead.

7. The system of claim 1, wherein the servicing component includes a cap adapted to cap the non-scanning printhead.

8. A system for servicing a non-scanning printhead, the system comprising:

a servicing plate;

a servicing component mounted on the servicing plate and adapted to service the non-scanning printhead;

a first actuator adapted to move the non-scanning printhead and the servicing plate in a first direction; and a second actuator adapted to move the servicing plate between a storage position and a service position in a second direction substantially perpendicular to the first direction, wherein the servicing component is spaced from the non-scanning printhead when the servicing plate is in the storage position and the servicing component is adapted to service the non-scanning printhead when the servicing plate is in the service position, wherein the first actuator is adapted to move the non-scanning printhead and the servicing plate in a combined direction including the first direction and the second direction.

9. The system of claim 8, wherein the servicing component includes a wiper adapted to wipe the non-scanning printhead.

10. The system of claim 8, wherein the servicing component includes a cap adapted to cap the non-scanning printhead.

11. A system for servicing a non-scanning printhead, the system comprising:

a servicing plate;

means mounted on the servicing plate for servicing the non-scanning printhead;

means for moving the non-scanning printhead and the servicing plate in a first direction; and means for moving the servicing plate in a second direction between a storage position and a service position, wherein the second direction is substantially perpendicular to the first direction.

12. The system of claim 11, wherein the first direction is substantially perpendicular to a face of the non-scanning printhead.

13. The system of claim 11, wherein the second direction is substantially parallel to a face of the non-scanning printhead.

14. The system of claim 11, wherein means for moving the servicing plate in the second direction includes means for spacing the means for servicing the non-scanning printhead from the non-scanning printhead when the servicing plate is in the storage position and positioning the means for servicing the non-scanning printhead to service the non-scanning printhead when the servicing plate is in the service position.

15. The system of claim 11, wherein means for moving the servicing plate in the second direction includes means for guiding the servicing plate between the storage position and the service position.

16. The system of claim 11, wherein the service position includes a first service position and a second service position, wherein means for moving the servicing plate in the second direction includes means for moving the servicing plate between the first service position and the second service position.

17. The system of claim 16, wherein means for servicing the non-scanning printhead includes a wiper for scraping the non-scanning printhead and a cap for sealing the non-scanning printhead.

18. The system of claim 17, wherein means for moving the servicing plate in the second direction includes means for servicing the non-scanning printhead with the wiper when the servicing plate is in the first service position and servicing the non-scanning printhead with the cap when the servicing plate is in the second service position.

19. A system for servicing a non-scanning printhead, the system comprising:

a servicing plate;

means mounted on the servicing plate for servicing the non-scanning printhead;

means for moving the non-scanning printhead and the servicing plate in a first direction; and means for moving the servicing plate in a second direction between a storage position and a service position, wherein the second direction is substantially perpendicular to the first direction, wherein means for moving the non-scanning printhead and the servicing plate in the first direction includes means for moving the non-scanning printhead and the servicing plate in a combined direction including the first direction and the second direction.

20. The system of claim 19, wherein means for servicing the non-scanning printhead includes a wiper for scraping the non-scanning printhead and a cap for sealing the non-scanning printhead.

21. The system of claim 20, wherein means for moving the servicing plate in the second direction includes means for servicing the non-scanning printhead with the wiper when the servicing plate is in the first service position and servicing the non-scanning printhead with the cap when the servicing plate is in the second service position.

22. A printing system, comprising:

a printhead mounting plate;

a non-scanning printhead supported by the printhead mounting plate;

a servicing plate movably connected to the printhead mounting plate;

a servicing component mounted on the servicing plate and adapted to service the non-scanning printhead;

a first actuator adapted to move the printhead mounting plate in a first direction; and a second actuator adapted to move the servicing plate between a storage position and a service position in a second direction substantially perpendicular to the first direction relative to the printhead mounting plate, wherein the servicing plate is recessed within the printhead mounting plate when the servicing plate is in the storage position, and wherein the servicing plate is spaced from the printhead mounting plate when the servicing plate is in the service position.

23. The printing system of claim 22, wherein the first direction is substantially perpendicular to a face of the non-scanning printhead.

24. The printing system of claim 22, wherein the second direction is substantially parallel to a face of the non-scanning printhead.

25. The printing system of claim 22, wherein the first actuator is adapted to move the printhead mounting plate in a combined direction including the first direction and the second direction.

26. The printing system of claim 22, further comprising:

a drive feature; and a drive element adapted to interact with the drive feature to move the servicing plate between the storage position and the service position.

27. The printing system of claim 22, wherein the servicing plate and the servicing component form a service station, the non-scanning printhead includes a plurality of non-scanning printheads each supported by the printhead mounting plate, and the service station includes a plurality of service stations each adapted to service one of the plurality of non-scanning printheads.

28. The printing system of claim 27, wherein the second actuator is adapted to move each of the plurality of service stations between the storage position and the service position.

29. The printing system of claim 27, wherein the plurality of non-scanning printheads are offset from each other and the plurality of service stations are correspondingly offset from each other.

30. A method of servicing a non-scanning printhead, the method comprising:

supporting the non-scanning printhead with a printhead mounting plate;

movably connecting a servicing plate with the printhead mounting plate;

mounting a first servicing component on the servicing plate;

moving the printhead mounting plate in a first direction; and moving the servicing plate in a second direction substantially perpendicular to the first direction, including moving the servicing plate between a storage position recessed within the printhead mounting plate and a first service position spaced from the printhead mounting plate, and servicing the non-scanning printhead with the first servicing component when the servicing plate is in the first service position.

31. The method of claim 30, wherein the first direction is substantially perpendicular to a face of the non-scanning printhead.

32. The method of claim 30, wherein the second direction is substantially parallel to a face of the non-scanning printhead.

33. The method of claim 30, wherein moving the printhead mounting plate includes moving the printhead mounting plate in a combined direction including the first direction and the second direction.

34. The method of claim 30, further comprising:

mounting a second servicing component on the servicing plate; and moving the servicing plate between the first service position and a second service position, including servicing the non-scanning printhead with the second servicing component when the servicing plate is in the second service position.

35. The method of claim 30, wherein supporting the non-scanning printhead includes supporting the non-scanning printhead relative to a platen, and wherein moving the printhead mounting plate includes moving the printhead mounting plate relative to the platen and spacing the printhead mounting plate from the platen.

* * * * *